US005219238A

United States Patent [19]

Hainbach

[11] Patent Number: 5,219,238

[45] Date of Patent: Jun. 15, 1993

[54] SURF WAX CONTAINER

[76] Inventor: Mark Hainbach, 3533 Old Conejo Rd., Apt. 106, Newbury Park, Calif. 91320

[21] Appl. No.: 923,546

[22] Filed: Aug. 3, 1992

[51] Int. Cl.[5] ..... B65D 25/38; B65D 83/04

[52] U.S. Cl. ..... 401/52; 401/82; 401/124; 401/125; 401/184; 206/579

[58] Field of Search ..... 401/82, 83, 98, 183, 401/195, 184, 52, 123-125; 206/579, 315.1, 314; 426/115; 220/624; 222/92

[56] References Cited

U.S. PATENT DOCUMENTS

| | | | |
|---|---|---|---|
| 1,850,934 | 3/1932 | Janer | 401/82 |
| 2,562,073 | 7/1951 | Vaughn | 401/184 |
| 2,574,130 | 11/1951 | Springborn et al. | 401/184 X |
| 2,626,847 | 1/1953 | Brown | 401/82 X |
| 3,443,874 | 5/1969 | Pelli et al. | 401/82 |

FOREIGN PATENT DOCUMENTS

| | | | |
|---|---|---|---|
| 448066 | 5/1949 | Italy | 401/184 |
| 190527 | 12/1922 | United Kingdom | 401/82 |

*Primary Examiner*—Danton D. DeMille
*Attorney, Agent, or Firm*—Jack C. Munro

[57] ABSTRACT

A container for a block of wax, said as surfboard wax, where the container utilizes a manually deflectable cup which provides the storage compartment for the wax. If per chance the block of wax has melted and then hardened assuming the precise shape of the cup, the bottom wall of the cup can be deflected in an upward manner thereby causing removal of the block of wax.

6 Claims, 1 Drawing Sheet

SURF WAX CONTAINER

BACKGROUND OF THE INVENTION

1) Field of the Invention

The field of this invention relates to a container for a substance and more particularly to a container for a substance that is readily meltable such as wax.

2) Description of Prior Art

It is common to coat the bottom surface of a surfboard with wax. The wax facilitates the movement of the surfboard through water. Wax is also used on other types of boards that are moved through water.

Surfboard wax is purchased by the user in the form of a block resembling the size and the shape of a hockey puck. Normally, the block of wax is merely wrapped in cellophane and is carried by the surfboarder to the desired site where it is used. Normally, desirable sites would be at or on a beach. At times, the wax is located within a vehicle such as a car or truck. Such an environment is normally involved with an elevated temperature especially within an enclosed vehicle. The wax only needs to be elevated to about 120 degrees Fahrenheit at which time the wax will melt. A melted glob of wax located on the floorboard or seats of an automobile not only damages the interior of the automobile but creates a rather unsightly mess that is difficult to clean. Also, the melted glob of wax ends up being thrown out and a new quantity of wax purchased.

In order to avoid melting of such wax it is common for surfboarders to carry the wax in a cooler. Invariably, though, the block of wax will be left unattended for a period of time and it certainly doesn't take very long for the wax to melt.

There is a need to develop some kind of a container for the wax itself that will confine the wax even if it melts and will still permit usage of the wax even after it is melted.

SUMMARY OF THE INVENTION

A container which is composed of a rigid base and a rigid top with the rigid top being removably connectable to the base. Interiorly of the base there is located a flexible walled cup. The base includes an open bottom which permits access to the cup. The block of wax is to be mounted within the cup with the top surface of the block of the wax coming into contact with a protective pad. This protective pad is placed within the interior of the lid. When the lid is removed, the cup can be deflected in an upward manner which will cause the wax to protrude exteriorly of the base. The lid is to include a comb storage compartment with such a comb being in common use for applying wax onto a surfboard.

The primary objective of the present invention is to construct a container that is to confine a quantity of surfboard wax even if the wax melts due to the application of a sufficient amount of heat.

Another objective of the present invention is to construct a container that permits usage of surfboard wax even after the wax is melted and is subsequently recooled.

Another objective of the present invention is to construct a container which facilitates the removal and usability of wax that has melted and rehardened.

Another objective of the present invention is to construct a container for surfboard wax that is manufactured at exceeding high quality and therefore can be used for a period of many years to store blocks of wax.

DETAILED DESCRIPTION OF THE SHOWN EMBODIMENT

Figure 1:
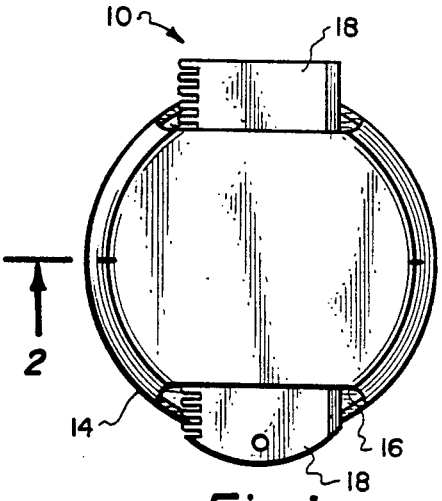
FIG. 1 is a top plan view of the container of the present invention showing a comb usable for application of wax to a surfboard being mounted in conjunction with the container.
Figure 4:
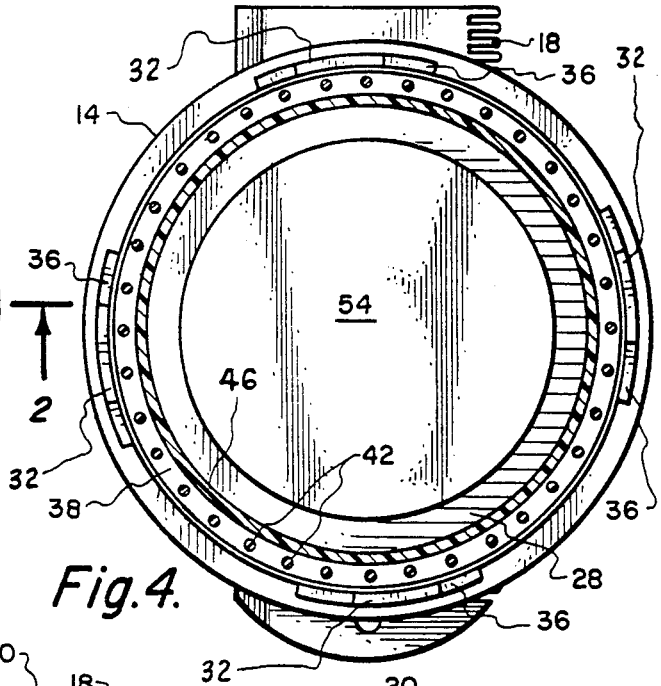
FIG. 4 is a transverse cross-sectional view through the container of the present invention taken along line 4—4 of FIG. 2.
Figure 2:
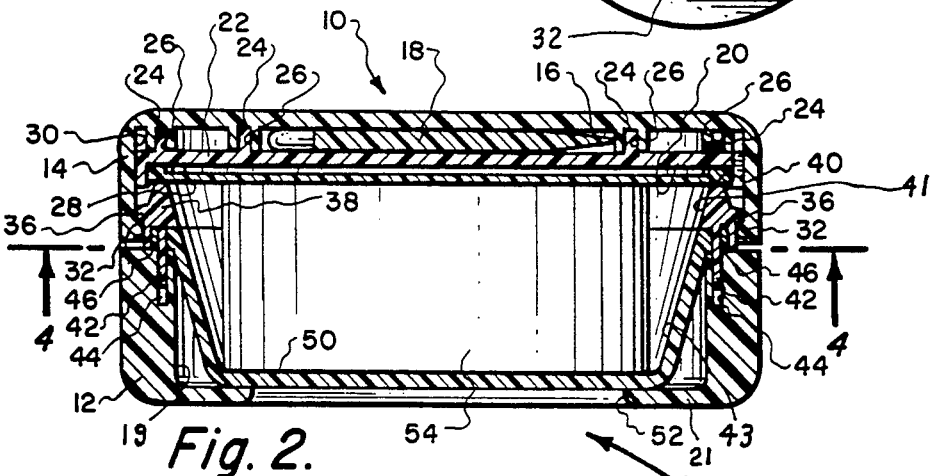
FIG. 2 is a cross-sectional view through the container of the present invention taken along line 2—2 of FIG. 1 showing the container in a closed configuration with a block of wax being contained therein.

Referring particularly to the drawing there is shown the container 10 of this invention which is composed primarily of a rigid base 12 and a rigid lid 14. The rigid lid 14 includes a through opening 16. Within the through opening 16 there is to be storable in a snug-fitting manner a surfboard wax applying comb 18. The use of such a comb 18 is deemed to be conventional and forms a specific part of this invention. The use of the through opening 16 is to provide a convenient location for storage of the comb 18 in conjunction with the container 10.

Figure 3:
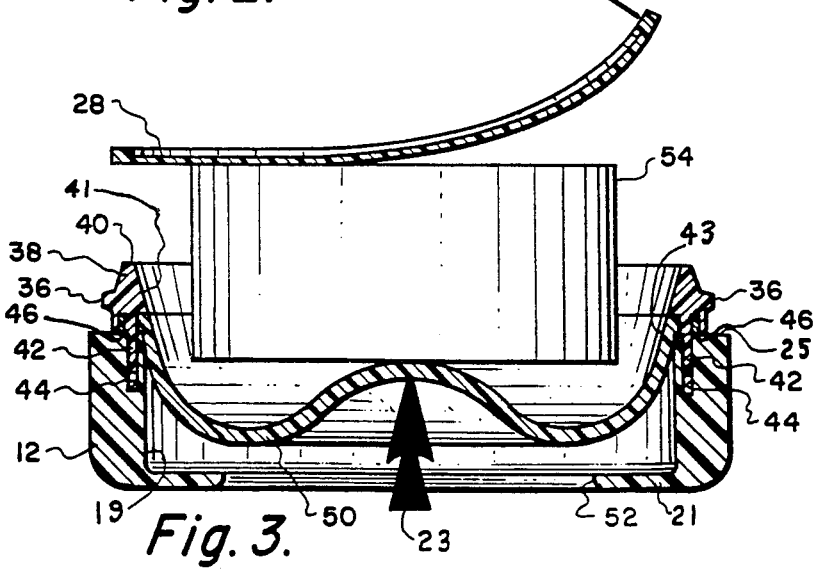
FIG. 3 is a view similar to FIG. 2 but showing the lid removed and the container being utilized to effect removal of a block of the wax by deflecting of the flexible walled cup mounted within the rigid base of the container of the present invention.

The rigid base 12 is basically cylindrical in configuration and includes an internal chamber 19. The rigid base 12 includes a bottom wall 21 which has an enlarged opening 52 formed therein. Access into the internal chamber 19 is provided through the enlarged opening 52. This access will normally be by insertion of a user's finger or thumb as is represented by arrow at 23. The user's finger or thumb is to apply manual pressure against bottom wall 50 of a flexible walled rubber type of cup. This application of manual force will cause the block of wax 54 contained within the cup and located against the bottom wall 50 to be moved exteriorly of the internal chamber 19 as is clearly depicted within FIG. 3 of the drawing.

The rigid base 12 includes an access opening which is defined by a ledge 25. Within this ledge 25 is located a mass of recesses 44 with thirty-six in number of such recesses 25 being shown in the drawing. However this number can be increased or decreased without departing from the scope of this invention. Mountable on the ledge 25 is a peripheral edge 46 of the cup which is integrally connected to the bottom wall 50 and is also constructed of rubber. Within the peripheral edge 46 there is formed a mass of holes with there being a hole for each recess 44. Also, each hole formed within the peripheral edge 46 would be of the same cross-sectional size as each recess 44.

A mounting ring 38 has a lower edge from which protrudes a mass of pins 42. A pin 42 is to be conducted through a hole formed in the peripheral edge 46. Each pin 42 is snugly retained within a recess 44. It is the function of the mounting ring 38 to securely hold in place the peripheral edge 46 of the cup in conjunction with the rigid base 12.

The mounting ring 38 includes an outer wall surface 41. Also, the mounting ring 38 includes a top edge 40 which is adapted to abut tightly against a protective pad 28 which is mounted within the interior cavity of the lid 14. The protective pad 28 will normally comprise no more than a flexible sheet of plastic. The pad 28 is to come into direct contact with the top of the wax block 54 and prevent direct contact between the wax block 54 and the top wall of the interior compartment 20 of the lid 14.

The mounting ring 38 also includes a plurality (four in number) evenly spaced apart and exteriorly mounted L-shaped members 36. Each of the L-shaped members 36 define a longitudinal cam slot having an opening within only one end thereof. Connectable with each said opening is a protuberance 32 with the four in number of the protuberances 32 being mounted in an evenly spaced apart manner on the inside wall surface of the lid 14. With each protuberance 32 engaging with an L-shaped member 36, there is achieved a locking action therebetween which secures together the lid 14 onto the base 12. It is to be understood that the securement of the lid 14 onto the base 12 is to facilitate removal of the lid 14. Removal of the lid 14 relative to the base 12 is accomplished by exerting relative turning motion between the base 12 and the lid 14.

The rubber cup includes an annular tapered interior wall 43. This interior wall 43 aligns with the interior tapered sidewall 41 of the mounting ring 38. It is to be understood that the mounting ring 38 will be constructed of a rigid material such as a plastic.

The lid 14 has formed within its internal compartment a plurality of protrusions which form a recess 26. Each recess 26 is to engage with a protrusion 24 which is integrally mounted on an interior lid member 22. The interior lid member 22 is located within the interior chamber 30 of the lid 14. Actually, the engagement between the protrusions 24 and the recesses 26 securely retain together the interior lid member 22 and the lid 14. The protective pad 28 rests against wall surface 20 of the interior lid member 22. The forming of the lid 14 to include the interior member 22 is solely to facilitate construction.

What is claimed is:

1. A container for a block of wax comprising:

a rigid base having an internal chamber, said base having an access opening providing access into said internal chamber, a ledge surrounding said access opening;

a cup mounted on said base and located within said internal chamber, said cup having a peripheral edge, said peripheral edge being fixed by fixing means to said ledge, said rigid base having a first bottom wall, said cup having a second bottom wall, said second bottom wall being located against said first bottom wall, a block of wax to be locatable within said cup and resting against said second bottom wall, said second bottom wall being deflectable towards said access opening and capable of being deflected to be in alignment with said access opening, manual deflection of said cup causes movement of the block of wax exteriorly of said internal chamber; and a lid removably engaged with said rigid base, said lid when engaged with said rigid base closing said internal chamber relative to the ambient, said lid being removable from said rigid base permitting access into said internal chamber.

2. The container as defined in claim 1 wherein:

said first bottom wall including an enlarged opening, said enlarged opening permitting manual contact with said second bottom wall of said cup to cause deflection of said second bottom wall.

3. The container as defined in claim 2 wherein:

said cup being constructed of a rubber material.

4. The container as defined in claim 1 wherein:

said lid having an internal compartment, said internal compartment having a top wall, a removable protective pad being connectable with said top wall, whereby said removable protective pad to be connectable with a block of wax and prevent direct connection of the block of wax with said top wall.

5. The container as defined in claim 1 wherein:

said lid having a comb receiving compartment adapted to store a comb when it is not being used.

6. A container for a block of wax comprising:

a rigid base having an internal chamber, said base having an access opening providing access into said internal chamber, a ledge surrounding said access opening;

a cup mounted on said base and located within said internal chamber, said rigid base and having a first bottom wall, said cup having a second bottom wall, said second bottom wall being located against said first bottom wall, a block of was to be locatable within said cup and resting against said second bottom wall, said second bottom wall being deflectable towards said access opening, whereby manual deflection of said cup causes movement of the block of wax exteriorly of said internal chamber;

a rigid lid removably engaged with said rigid base, said rigid lid when engaged with said rigid base closing said internal chamber relative to the ambient, said rigid lid being removable from said rigid base permitting access into said internal chamber;

said first bottom wall including an enlarged opening, said enlarged opening permitting manual contact with said second bottom wall of said cup to cause deflection of said second bottom wall;

said cup being constructed of a rubber material;

said peripheral edge being annular, said cup having a peripheral edge, said peripheral edge having a plurality of holes, said ledge having a plurality of recesses, a said hole to connect with a said recess; a mounting ring including a plurality of spaced apart pins, said mounting ring being mountable on said peripheral edge with each said pin to pass through a said hole to be locatable within a said recess.

* * * * *